US008534816B2

(12) United States Patent
Takagi et al.

(10) Patent No.: US 8,534,816 B2
(45) Date of Patent: Sep. 17, 2013

(54) CARTRIDGE AND METHOD OF MANUFACTURING THEREOF

(75) Inventors: Yuki Takagi, Nagoya (JP); Toyonori Sasaki, Anjo (JP); Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/618,586

(22) Filed: Sep. 14, 2012

(65) Prior Publication Data

US 2013/0162731 A1 Jun. 27, 2013

(30) Foreign Application Priority Data

Dec. 22, 2011 (JP) ..... 2011-282159

(51) Int. Cl.
*B41J 2/175* (2006.01)
*B41J 29/393* (2006.01)

(52) U.S. Cl.
USPC ..... 347/86; 347/19

(58) Field of Classification Search
USPC ..... 347/19, 85, 86
See application file for complete search history.

(56) References Cited

U.S. PATENT DOCUMENTS 5,975,688 A 11/1999 Kanaya et al.
6,416,152 B1 7/2002 Matsuzaki et al.
6,502,917 B1 * 1/2003 Shinada et al. ..... 347/19
7,784,923 B2 * 8/2010 Ishizawa et al. ..... 347/85
8,123,343 B2 * 2/2012 Shinada et al. ..... 347/86
8,297,739 B1 * 10/2012 Kodama et al. ..... 347/49
2005/0146576 A1 7/2005 Shinada et al.
2005/0195255 A1 9/2005 Shinada et al.
2006/0033790 A1 2/2006 Shinada et al.
2006/0119677 A1 6/2006 Shinada et al.
2006/0203050 A1 9/2006 Shinada et al.
2007/0247501 A1 10/2007 Shinada et al.
2008/0284830 A1 11/2008 Shinada et al.
2009/0009560 A1 1/2009 Shinada et al.
2009/0027453 A1 1/2009 Shinada et al.
2009/0040274 A1 2/2009 Shinada et al.
2009/0040275 A1 2/2009 Shinada et al.
2011/0273520 A1 11/2011 Shinada et al.

FOREIGN PATENT DOCUMENTS

JP H09-039265 A 2/1997
JP 2003-054003 A 2/2003

* cited by examiner

*Primary Examiner* — Anh T. N. Vo
(74) *Attorney, Agent, or Firm* — Baker Botts L.L.P.

(57) ABSTRACT

A cartridge includes a main body having a chamber formed therein and configured to receive an imaging material, a circuit board having a first opening and a second opening formed through the circuit board, and an electrode disposed on the circuit board. The main body includes a support surface that supports the circuit board, a first protrusion and a second protrusion protruding from the support surface, such that a portion of the first protrusion is disposed in the first opening of the circuit board and a portion of the second protrusion is disposed in the second opening of the circuit board, a third protrusion protruding from the support surface adjacent to the circuit board; and a fixing element that contacts a portion of the circuit board and a portion of the third protrusion to affix the circuit board to the support surface of the main body.

10 Claims, 7 Drawing Sheets

CARTRIDGE AND METHOD OF MANUFACTURING THEREOF

CROSS-REFERENCE TO RELATED APPLICATION

This application claims priority from Japanese Patent Application No. 2011-282159, filed on Dec. 22, 2011, which is incorporated herein by reference.

BACKGROUND OF THE INVENTION

1. Field of the Invention

The invention relates generally to a cartridge comprising an electrical interface, and a method of manufacturing the cartridge.

2. Description of Related Art

A known inkjet recording apparatus is configured to record an image onto a recording medium, e.g., a recording sheet, with ink. The known inkjet recording apparatus includes an inkjet-type recording head. The recording head is configured to selectively eject ink, which is supplied from an ink cartridge, from nozzles toward a recording sheet. The ink cartridge is configured to attached to and detached from the known inkjet recording apparatus.

Known ink cartridges are configured to store ink of one of a plurality of colors, e.g., cyan, magenta, yellow and black. The known ink cartridges may store ink having different characteristics, i.e., pigment ink or dye ink. In order to prevent ink mixture or ink solidification, an inkjet recording apparatus may identify the color or characteristics of the ink stored in an ink cartridge attached to the inkjet recording apparatus. For identification of an ink cartridge, the ink cartridge may include a storage device, i.e., an integrated circuit ("IC") chip, that is configured to store information about the ink cartridge, i.e., ink color.

SUMMARY OF THE INVENTION

When an IC chip is mounted on an ink cartridge, a certain degree of positioning accuracy may be required. For example, a contact provided in a cartridge mount may contact an electrode of the IC chip of the ink cartridge, even when the ink cartridge attached in the cartridge mount deviates from its desired or intended position in an ink cartridge inserting direction. When an IC chip includes a plurality of electrodes, each of a plurality of contacts provided in the cartridge mount may contact one of the plurality of electrodes of the IC chip, respectively. The positioning of the IC chip may be implemented through image processing. Nevertheless, assembly of the ink cartridge may become complicated.

The present invention may provide a method for positioning and fixing an electrical interface in a printing liquid cartridge.

The IC chip may be fixed, such that the IC chip does not detach from the ink cartridge or become misaligned due to impact during shipment or due to the ink cartridge falling on a hard surface. Further, the IC chip may be fixed to the ink cartridge with a certain degree of positional accuracy and reliability while reducing manufacturing cost.

According to an embodiment of the invention, a cartridge comprising: a main body having a chamber formed therein and configured to receive an imaging material; a circuit board having a first opening and a second opening formed through the circuit board; and an electrode disposed on the circuit board, wherein the main body comprises: a support surface configured to support the circuit board; a first protrusion and a second protrusion protruding from the support surface, such that a portion of the first protrusion is disposed in the first opening of the circuit board and a portion of the second protrusion is disposed in the second opening of the circuit board; a third protrusion protruding from the support surface adjacent to the circuit board; and a fixing element that contacts a portion of the circuit board and a portion of the third protrusion to affix the circuit board to the support surface of the main body.

According to another embodiment of the invention, A method for affixing a circuit board to a support surface of a cartridge, the method comprising: positioning the circuit board on the support surface, such that a portion of a first protrusion protruding from the support surface is disposed in a first opening of the circuit board and a portion of a second protrusion protruding from the support surface is disposed in a second opening of the circuit board; positioning a fixing element on a third protrusion protruding from the support surface, such that the fixing element covers a portion of a surface of the circuit board facing away from the support surface; heating the fixing element to melt a portion of the fixing element, such that the melted portion of the fixing element is affixed to the third protrusion and the portion of the surface of the circuit board.

Other objects, features, and advantages of an embodiment of the invention will be apparent to persons of ordinary skill in the art from the following description of an embodiment with reference to the accompanying drawings.

BRIEF DESCRIPTION OF THE DRAWINGS

For a more complete understanding of the present invention, needs satisfied thereby, and the objects, features, and advantages thereof, reference now is made to the following descriptions taken in connection with the accompanying drawing.

DETAILED DESCRIPTION OF EMBODIMENTS OF THE INVENTION

Figure 1:
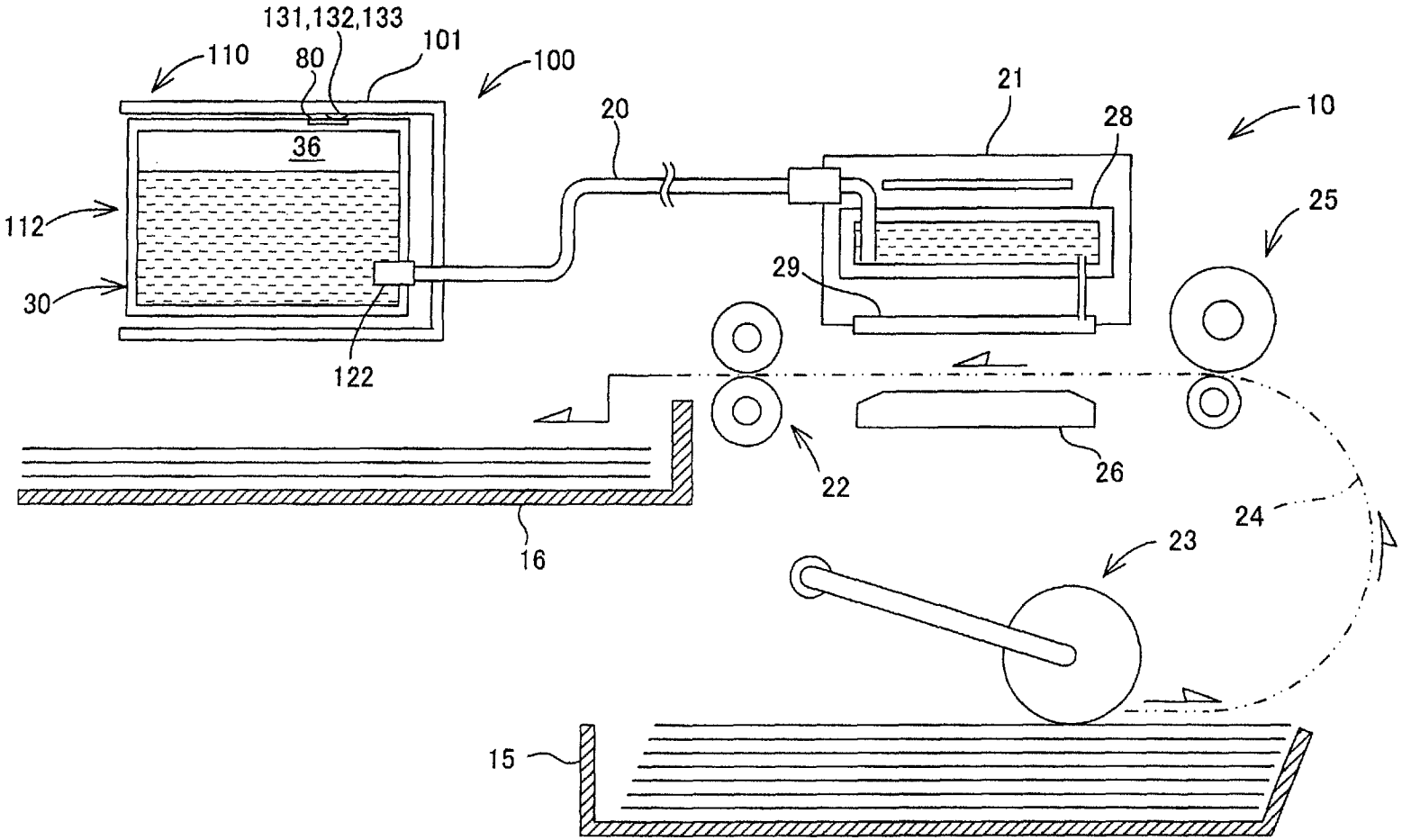
FIG. 1 is a schematic and cross-sectional view depicting an internal configuration of an inkjet recording apparatus according to an embodiment of the invention.

Embodiments of the invention now are described in detail with reference to the accompanying drawings; like reference numerals are used for corresponding parts in the various drawings.

Referring to FIG. 1, a printer 10, e.g., an Inkjet recording apparatus, may be configured to record an image on a recording sheet by selectively ejecting ink droplets onto the recording sheet using an Inkjet recording system. Printer 10 may comprise an ink supply device 100. Ink supply device 100 may comprise a cartridge mount 110. Cartridge mount 110 may be configured to receive an ink cartridge 30, e.g., a cartridge. Cartridge mount 110 may have an opening 12 formed at an open side. Ink cartridge 30 may be inserted into or removed from cartridge mount 110 selectively via opening 112.

Ink cartridge 30 may be configured to store ink, e.g., imaging material, to be used in printer 10. When ink cartridge 30 is mounted to cartridge mount 110, ink cartridge 30 and a recording head 21 may be connected to each other via an ink tube 20. Recording head 21 may comprise a sub tank 28. Sub tank 28 may be configured to temporarily store ink supplied via ink tube 20 from ink cartridge 30. Recording head 21 may be configured to selectively eject ink, which is supplied from sub tank 28, from nozzles 29.

In printer 10, a feed roller 23 may feed recording sheets one by one from a sheet feed tray 15 to a conveying path 24. A conveyor roller pair 25 may further convey the recording sheet onto a platen 26. Recording head 21 may be configured to selectively eject ink onto the recording sheet that is passing over platen 26 to record an image on the recording sheet. A discharge roller pair 22 then may discharge the recording sheet, which has passed over platen 26, onto a sheet discharge tray 16 disposed at a downstream end of conveying path 24.

As depicted in FIG. 1, printer 10 may comprise ink supply device 100. Ink supply device 100 may be configured to supply ink to recording head 21 of printer 10. Ink supply device 100 may comprise cartridge mount 110, to which ink cartridge 30 may be mounted. As depicted in FIG. 1, ink cartridge 30 may be placed in cartridge mount 110.

Figure 2:
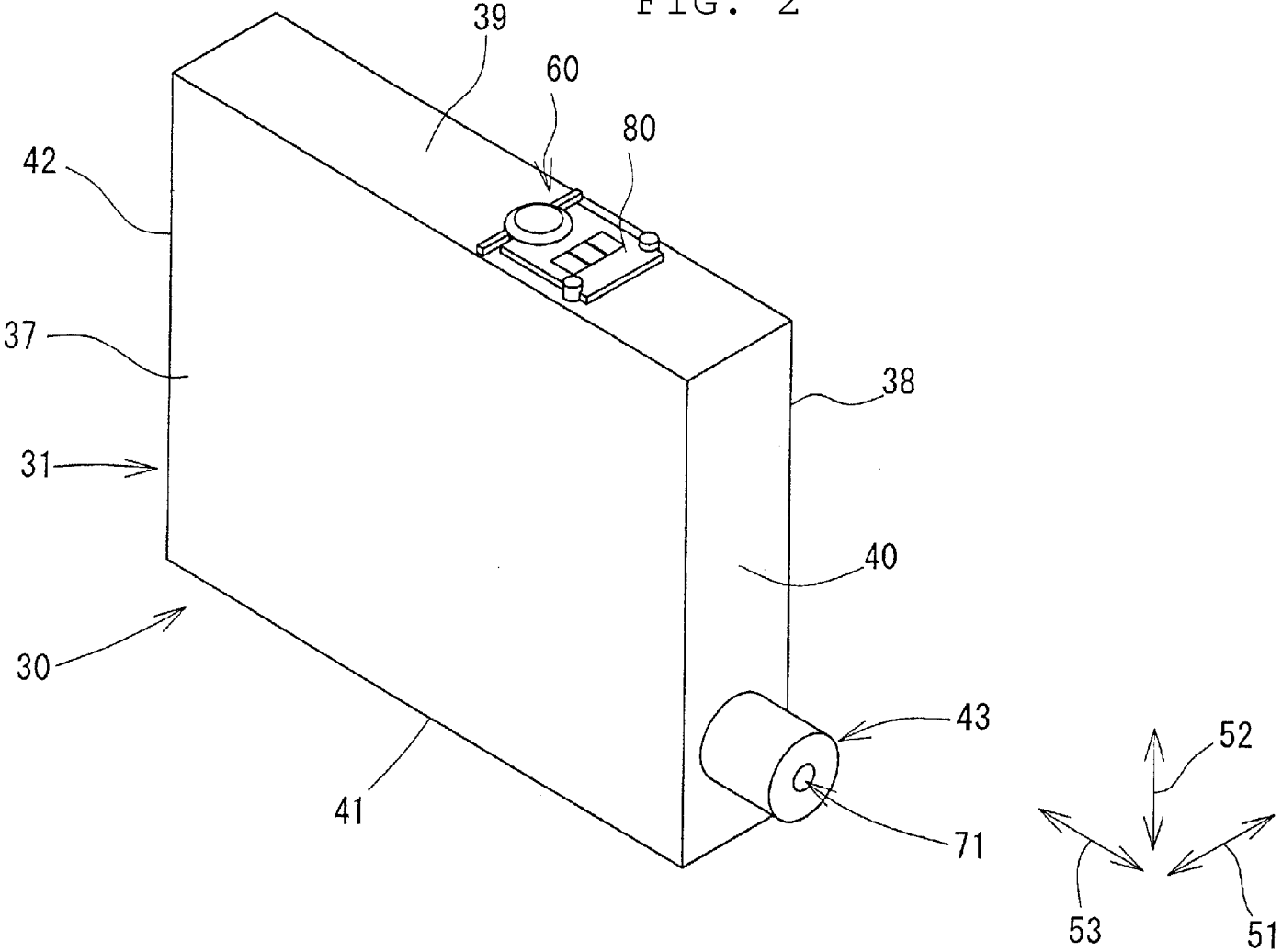
FIG. 2 is a perspective view depicting an ink cartridge according to an embodiment of the invention.
Figure 6:
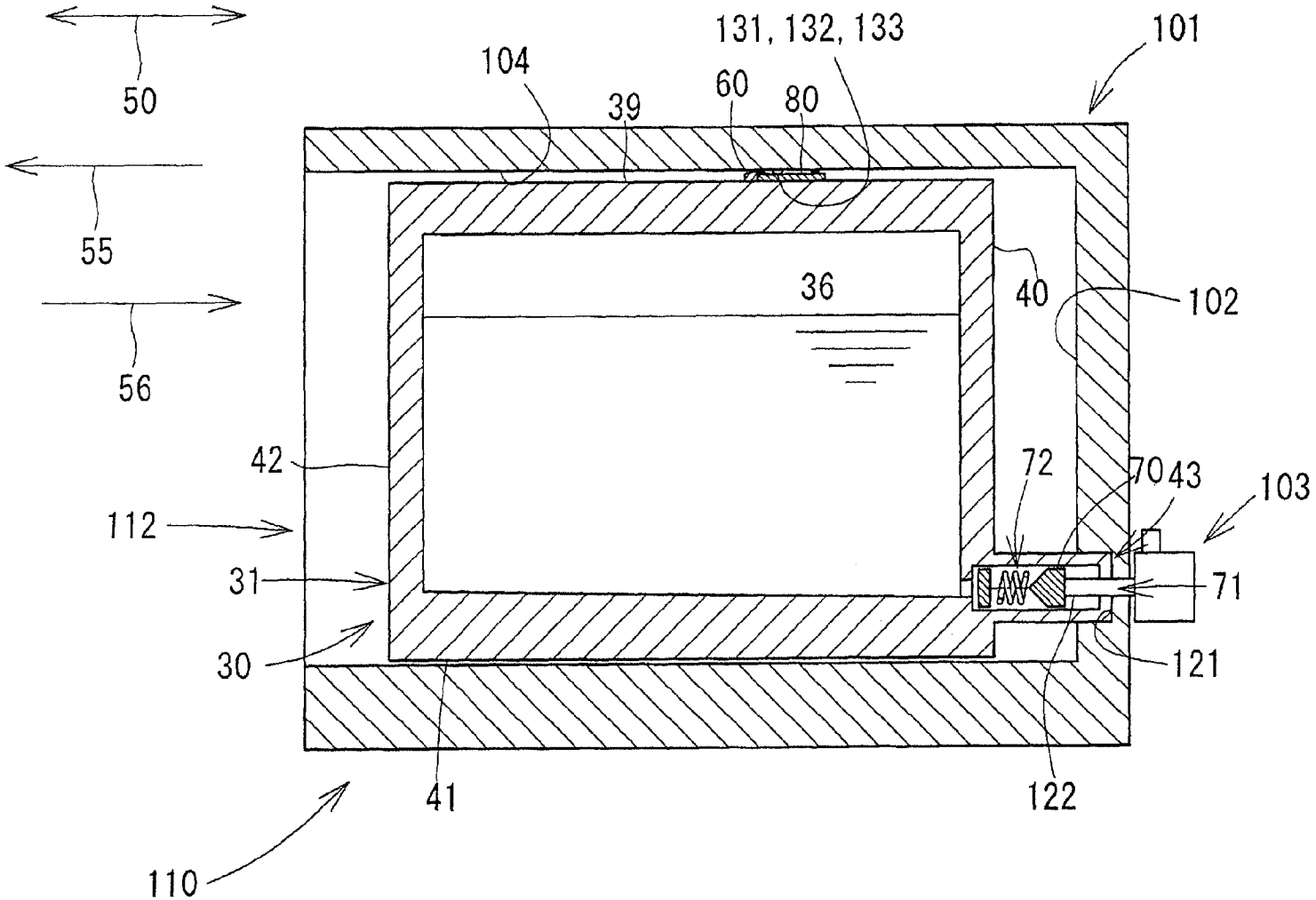
FIG. 6 is a cross-sectional view depicting a cartridge mount and an ink cartridge placed in the cartridge mount according to an embodiment of the invention.

Referring to FIG. 2, ink cartridge 30 may be a container configured to store ink therein. Ink cartridge 30 may have a space formed therein that may serve as an ink chamber 36, as shown in FIG. 6, for storing ink. Ink chamber 36, e.g., a chamber, may be defined by and contained within a main body 31. In another embodiment, ink chamber 36 may be defined by a member other than main body 31.

Figure 5:
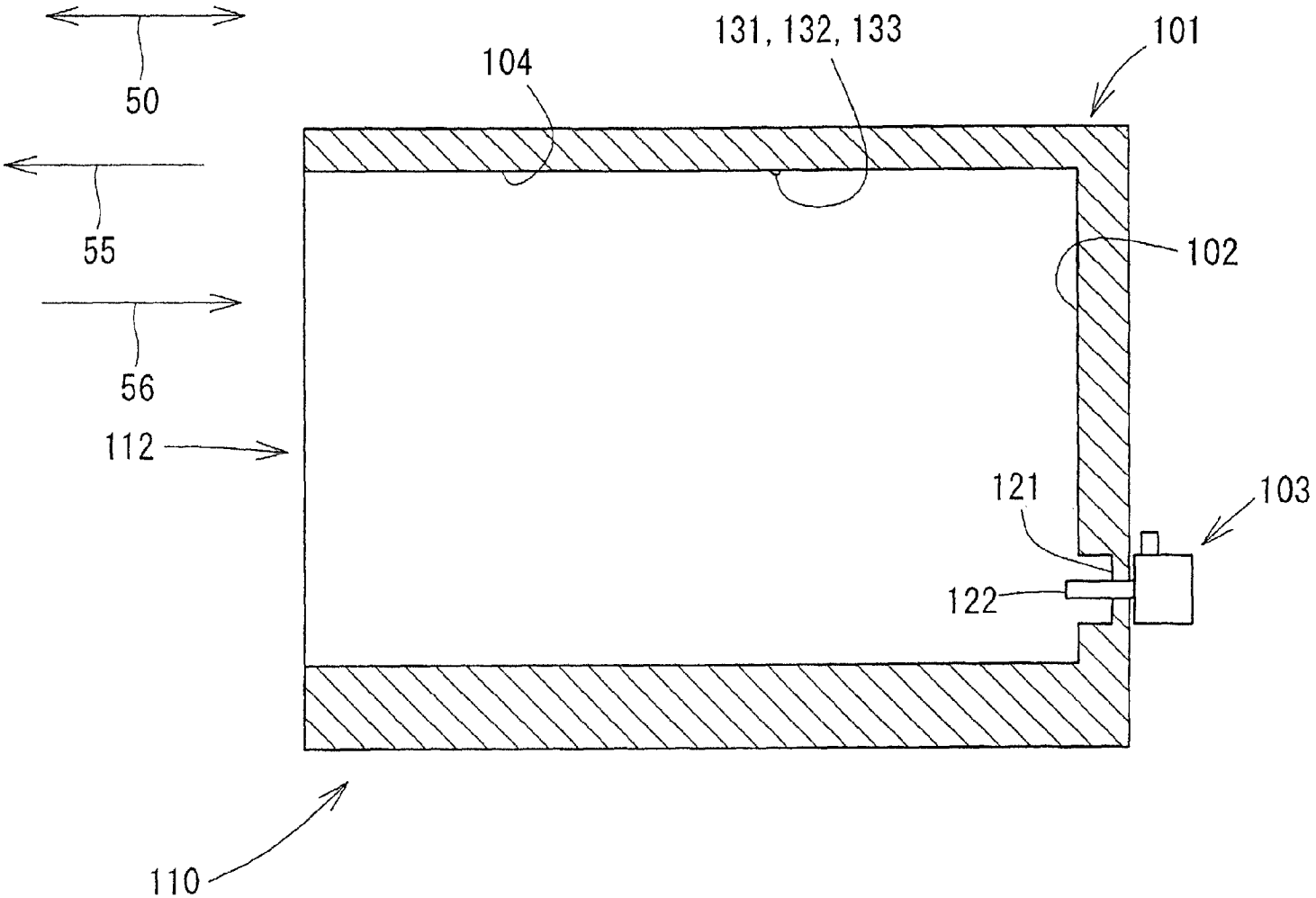
FIG. 5 is a cross-sectional view depicting a cartridge mount according to an embodiment of the invention.

Ink cartridge 30 may be inserted into or removed from cartridge mount 110 in insertion and removal directions 50, as depicted in FIG. 6. Ink cartridge 30 may be inserted into cartridge mount 110 along an insertion direction 56, as depicted in FIG. 5, and may be removed from cartridge mount 110 along a removal direction 55, as depicted in FIG. 5. Insertion direction 56 may be the direction in which ink cartridge 30 may be inserted into cartridge mount 110, and removal direction 55 may be the direction in winch ink cartridge 30 may be removed from cartridge mount 110. A height direction 52 of ink cartridge 30 may be parallel to a direction of gravity.

Main body 31 may have a substantially rectangular parallelepiped shape. Main body 31 may have a relatively thin-walled body in which a dimension in height direction 52 and a dimension in a length direction 53 may be greater than a dimension in a width direction 51. A front wall 40, e.g., a first surface of the main body, may define a front portion of main body 31 with respect to insertion direction 56, and a rear wall 42, e.g., a rear surface, may define the rear of main body 31 with respect to insertion direction 56. Front wall 40 and rear wall 42 may be disposed opposite to each other in length direction 53. Main body 31 may be defined by front wall 40, rear wall 42, an upper wall 39, e.g., a support surface, and a lower wall 41. Upper wall 39 may extend between and connect an upper edge of front wall 40 and an upper edge of rear wall 42. Lower wall 41 may extend between and connect a lower edge of front wall 40 and a lower edge of rear wall 42. A pair of side walls 37 and 38 may be spaced from each other in width direction 51 and may connect to edges of upper wall 39, front wall 40, lower wall 41, and rear wall 42. Insertion and removal direction 50 may be parallel to length direction 53. Insertion and removal direction 50 may be perpendicular to front wall 40 of main body 31.

Main body 31 may comprise an ink outlet portion 43 disposed at front wall 40. Ink outlet portion 43 may be disposed in the lower portion of main body 31 at a position lower than a middle position of front wall 40 in height direction 52. Ink outlet portion 43 may be cylindrical in its outer shape and may protrude outward from front wall 40 along length direction 53. A protruding end of ink outlet portion 43 may have an ink outlet port 71.

As depicted in FIG. 6, ink outlet portion 43 may have an ink channel 72 formed therein. Ink channel 72 may extend from ink outlet port 71 to ink chamber 36 via an internal space of ink outlet portion 43 along length direction 53 and may place ink chamber 36 in fluid communication with ink outlet port 71. An ink outlet valve 70 may be disposed in ink channel 72 and configured to selectively open and close ink outlet port 71. When ink cartridge 30 is mounted to cartridge mount 110, a hollow tube 122 of cartridge mount 110 may enter ink outlet port 71 to open ink outlet valve 70. Thus, ink may flow from ink chamber 36 into hollow tube 122 of cartridge mount 110 through ink channel 72. Ink outlet portion 43 may correspond to an imaging material outlet portion.

In another embodiment, ink outlet port 71 may be sealed with a film or a rubber stopper. When ink cartridge 30 is mounted to cartridge mount 110, hollow tube 122 may penetrate the film or the rubber stopper to open ink outlet port 71.

Figure 3:
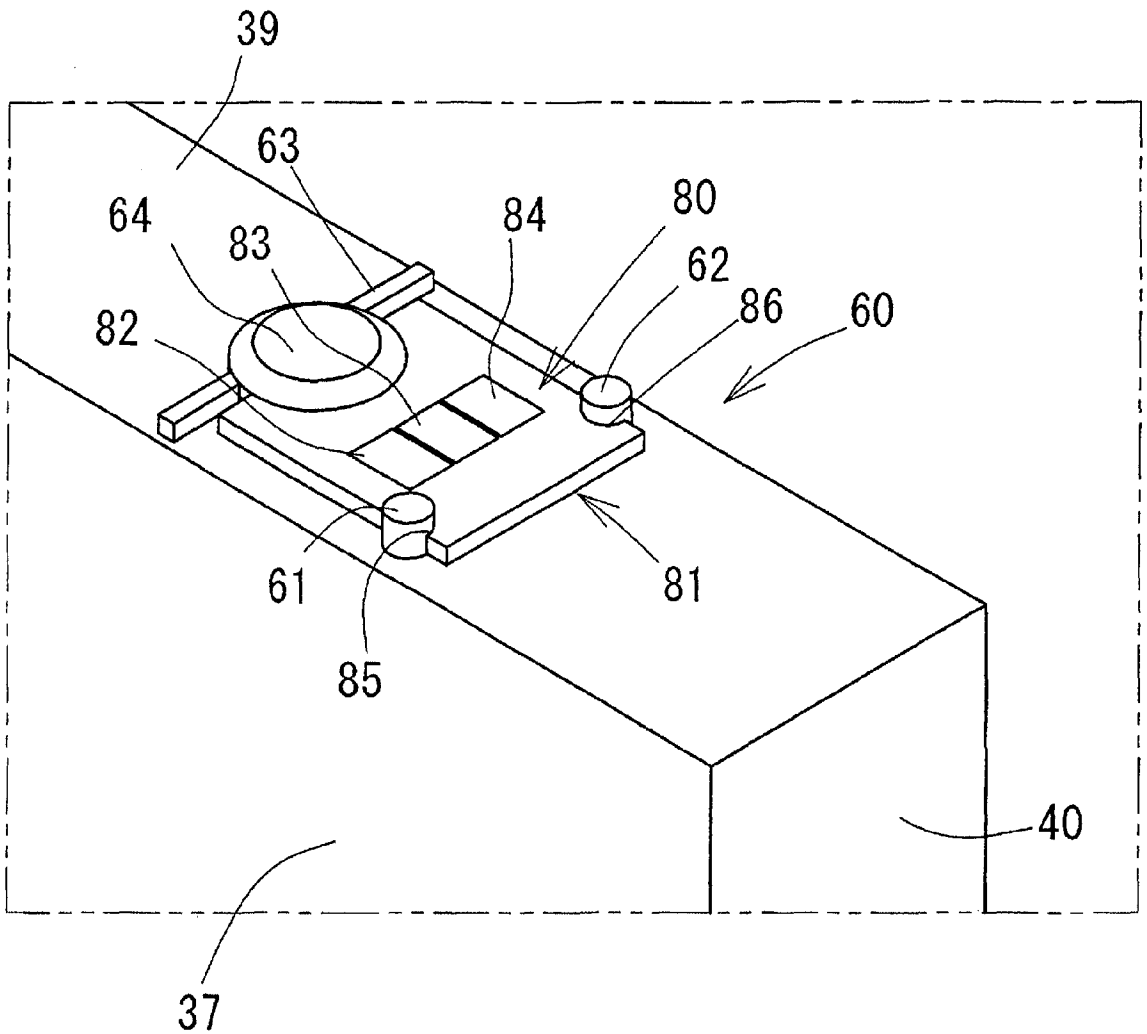
FIG. 3 is an enlarged view depicting an IC substrate affixed to the ink cartridge according to the embodiment of the invention depicted in FIG. 2.
Figure 4:
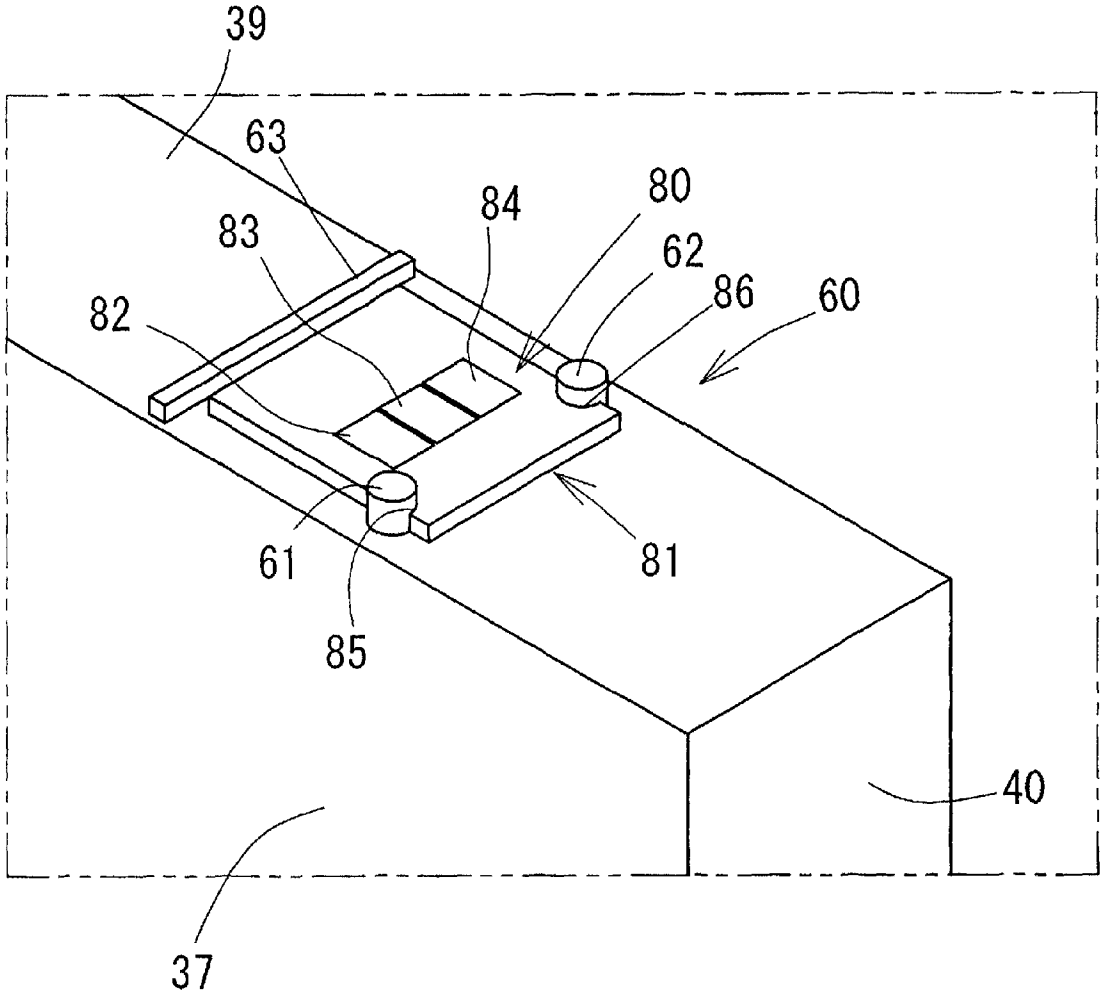
FIG. 4 is an enlarged view depicting the IC substrate of FIG. 3 before an IC substrate is affixed to the ink cartridge according to the embodiment of the invention depicted in FIG. 2.

As depicted in FIGS. 2 and 3, a substrate support 60 may be disposed on upper wall 39 of main body 31. Substrate support 60 may be positioned closer to front wall 40 than to a middle position bisecting upper wall 39 between front wall 40 and rear wall 42. Substrate support 60 may comprise protrusions 61 and 62, e.g., a first protrusion and a second protrusion, a rib 63, and a fixing layer 64, e.g., a fixing element. Protrusions 61 and 62 may protrude from an outer surface, which may be defined by upper wall 39 as a support surface, in a direction from the support surface. Rib 63, e.g., a third protrusion, may protrude from upper wall 39 at a position closer to rear wall 42 than that at which protrusions 61 and 62 are positioned in the length direction 53.

Protrusions 61 and 62 may have symmetrical shapes with respect to a center line extending along length direction 53 through a center of upper wall 39 in width direction 51. Each of protrusions 61 and 62 may have a cylindrical shape and may protrude upward from upper wall 39. Protrusions 61 and 62 may be separated from each other in width direction 51. A distance between protrusions 61 and 62 may be greater than a width of IC substrate 80, including all of electrodes 82, 83 and 84, in width direction 51. Protrusions 61 and 62 may be disposed at positions at which protrusions 61 and 62 may engage a pair of notches 85 and 86, e.g., a first opening and a second opening.

Rib 63 may be disposed at a position closer to rear wall 42 than that at which protrusions 61 and 62 on upper wall 39 are positioned. Rib 63 may protrude upward from upper wall 39 and may extend along width direction 51. When IC substrate 80 is positioned on upper wall 39 by protrusions 61 and 62 in length direction 53, a gap may form between a rear end of IC substrate 80 and rib 63. Fixing layer 64 may be applied to an upper surface of IC substrate 80 and an upper surface of rib 63 to fill the gap formed therebetween. Fixing layer 64 may comprise a resin, such as a hot-melt adhesive, that may be melted by heating and may re-solidify when cooled.

IC substrate 80 may be disposed on upper wall 39 of main body 31 and supported by substrate support 60. An electrical connection may be established between IC substrate 80 and contacts 131, 132 and 133, as depicted in FIG. 6, during the mounting of ink cartridge 30 to cartridge mount 110. The electrical connection may be maintained when ink cartridge 30 is mounted in cartridge mount 110. IC substrate 80 may correspond to an electrical interface between ink cartridge 30 and cartridge mount 110.

IC substrate 80 may comprise a HOT electrode 82, a GND electrode 83, and a signal electrode 84 on an upper surface of a circuit board 81. IC substrate 80 may also comprise an IC circuit on a lower surface of circuit board 81. The IC may be a semiconductor integrated circuit and may be configured to store data indicating information about ink cartridge 30, e.g., one or more of a lot number, a date of manufacture, and ink color. The data stored in the IC may be read out by printer 10.

Circuit board 81 may be a rectangular plate in plan view. Circuit board 81 may comprise HOT electrode 82, GND electrode 83, and signal electrode 84 arranged on the upper surface thereof along width direction 51. HOT electrode 82, GND electrode 83, and signal electrode 84 may be electrically connected with the IC. HOT electrode 82, GND electrode 83, and signal electrode 84 may be elongated along length direction 53 and may be separated from each other in width direction 51.

Circuit board 81 may have a pair of notches 85 and 86, each formed in one of the sides of circuit board 81 in width direction 51 at respective positions closer to front wall 40 than those at which HOT electrode 82, GND electrode 83, and signal electrode 84 are positioned. Circuit board 81 may be partially cut away in its thickness direction to define notches 85 and 86. Notches 85 and 86 may be separated from each other in width direction 51. Notches 85 and 86 may extend inward from respective ends of circuit board 81 in width direction 51. Each of notches 85 and 86 may have a semicircular shape, and each of notches 85 and 86 may have a size slightly greater than an outside diameter of each corresponding cylindrical protrusion 61 and 62, such that notches 85 and 86 may engage each corresponding protrusion 61 and 62. Notches 85 and 86 may be disposed at respective positions off set from HOT electrode 82, GND electrode 83, and signal electrode 84 so as not to be overlapped by HOT electrode 82, GND electrode 83, and signal electrode 84 in width direction 51. Notches 85 and 86 may be disposed inward from the respective ends of circuit board 81 in width direction 51 so as not to reach HOT electrode 82, GND electrode 83, and signal electrode 84.

Protrusions 61 and 62 and notches 85 and 86 may have any shapes as long as circuit board 81 may be positioned in length direction 53 by the engagement between protrusions 61 and 62 and respective notches 85 and 86. Circuit board 81 may be positioned in width direction 51 by the engagement between protrusions 61 and 62 and respective notches 85, 86.

When each of protrusions 61 and 62 engages a corresponding one of notches 85 and 86, a resin melted by heating may be applied to the gap between rib 63 and circuit board 81. The melted resin may enter the gap between rib 63 and circuit board 81 and may spread over at least a portion of circuit board 81. The melted resin may be cooled after heating and may solidify to become fixing layer 64. The gap between rib 63 and circuit board 81 may be filled with fixing layer 64, and fixing layer 64 may tightly contact the surface of circuit board 81 like a brim. As described above, circuit board 81 may be affixed to upper wall 39 by the heating and cooling of fixing layer 64 and by the contact between protrusions 61 and 62 and respective notches 85 and 86.

As depicted FIG. 5, cartridge mount 110 may comprise a case 101 serving as a housing. Case 101 may have a rectangular, parallelepiped shape having opening 112 formed in the front side of printer 10. Ink cartridge 30 may selectively be inserted into and removed from case 101 via opening 112. Case 101 may be configured to accommodate a plurality, e.g., four, ink cartridges 30 in a plurality of colors, e.g., cyan, magenta, yellow, and black.

Case 101 may have a side inner surface 102 at a side opposite from opening 112 in insertion and removal direction 50. Side inner surface 102 may define a portion of an internal space of case 101. Connectors 103 may be disposed at a lower part of side inner surface 102 of case 101. Connectors 103 may be disposed at side inner surface 102 at positions that may correspond to ink outlet portions 43 of ink cartridges 30 mounted in case 101.

Each connector 103 may comprise hollow tube 122 and a holding portion 121. Hollow tubes 122 may be connected with respective ink tubes 20 at an outer surface that opposite from side inner surface 102 of case 101. Ink tubes 20 may be connected with respective hollow tubes 122 to allow ink to flow into recording head 21 of printer 10.

Each holding portion 121 may be a cylindrically recessed portion formed in side inner surface 102 of case 101. Hollow tube 122 may be disposed at a substantially middle portion of holding portion 121 along insertion and removal direction 50. As depicted in FIG. 6, when ink cartridge 30 is mounted to cartridge mount 110, ink outlet portion 43 having a cylindrical shape may be inserted into cylindrical holding portion 121. In this configuration, a circumference of ink outlet portion 43 may tightly contact a surface defining holding portion 121. When ink outlet portion 43 is inserted into holding portion 121, hollow tube 122 may be inserted into ink outlet port 71 of ink outlet portion 43, and hollow tube 122 may move ink outlet valve 70. Thus, ink outlet valve 70 disposed in a closed position may move to an open position against an urging force from a coil spring 73, and, therefore, ink stored in ink chamber 36 may flow to the outside of ink cartridge 30. Ink from ink chamber 36 may flow into hollow tube 122 and further into recording head 21 via ink tube 20 due to the pressure head differential between ink chamber 36 and recording head 21.

As depicted in FIG. 5, case 101 may comprise contacts 131, 132, and 133 disposed on an upper inner surface 104 of case 101 at a position between side inner surface 102 and opening 112 along insertion and removal direction 50. Contacts 131, 132, and 133 may be separated from each other in a direction orthogonal to insertion and removal direction 50. Contacts 131, 132, and 133 may be disposed so as to correspond to HOT electrode 82, GND electrode 83, and signal electrode 84 of ink cartridge 30, respectively.

Contacts 131, 132, and 133 may be electrically connected with a controller. The controller may comprise, for example, a central-processing unit ("CPU"), a read-only memory ("ROM"), a random-access memory ("RAM") and may be configured as a control device of printer 10. Contact 131 may apply voltage Vc to HOT electrode 82 by establishing electrical connection with HOT electrode 82. Contact 132 may allow GND electrode 83 to establish a ground by establishing electrical connection, with GND electrode 83. Contacts 131 and 132 may supply power to circuit board 81 by establishing electrical connection with HOT electrode 82 and GND electrode 83, respectively. Contact 133 may access data stored in circuit board 81 by establishing electrical connection with signal electrode 84.

As depicted in FIG. 6, during the mounting of ink cartridge 30 to cartridge mount 110, HOT electrode 82, GND electrode 83, and signal electrode 84 of IC substrate 80 may contact respective contacts 131, 132, and 133, respectively, at a predetermined timing, and electrical connection may be established therebetween. More specifically, during the mounting of ink cartridge 30 to cartridge mount 110, contacts 131, 132, and 133 may pass between protrusions 61 and 62 and contact, a front-side surface of circuit board 81 or an upper edge of the front side-surface of circuit board 81. Contacts 131, 132, and 133 then may move rearward relative to front wall 40 while sliding over the upper surface of circuit board 81, and may be electrically connected with HOT electrode 82, GND electrode 83, and signal electrode 84, respectively. As described above, in substrate support 60, protrusions 61 and 62 may respectively be disposed outside the outermost ones of HOT electrode 82, GND electrode 83, and signal electrode 84 of IC substrate 80 in width direction 51. Accordingly, contacts 131, 132, and 133 may contact HOT electrode 82, GND electrode 83, and signal electrode 84, respectively, of circuit board 81 without contacting protrusions 61 and 62.

Circuit board 81 of IC substrate 80 may be disposed on upper wall 39 in length direction 53 by the engagement between notches 85 and 86 and respective protrusions 61 and 62. Circuit board 81 may be affixed onto upper wall 39 by fixing layer 64, which may be applied to IC circuit board 80 at the position behind electrodes 82, 83, and 84 in length direction 53. By doing so, IC substrate 80 may be securely positioned and affixed accurately to main body 31.

Protrusions 61 and 62 may be disposed outside the outermost ones of electrodes 82, 83, and 84 and separated from each other at a distance in width direction 51. Protrusions 61 and 62 may be disposed at the respective positions offset from electrodes 82, 83, and 84. With this arrangement, during the mounting of ink cartridge 30 to cartridge mount 110, contacts 131, 132, and 133 may have access to electrodes 82, 83, and 84 without contacting protrusions 61 and 62. Because contacts 131, 132, and 133 do not contact protrusions 61 and 62 during the mounting of ink cartridge 30 to cartridge mount 110, operational load during the mounting of ink cartridge 30 to cartridge mount 110 may be reduced.

Figure 7:
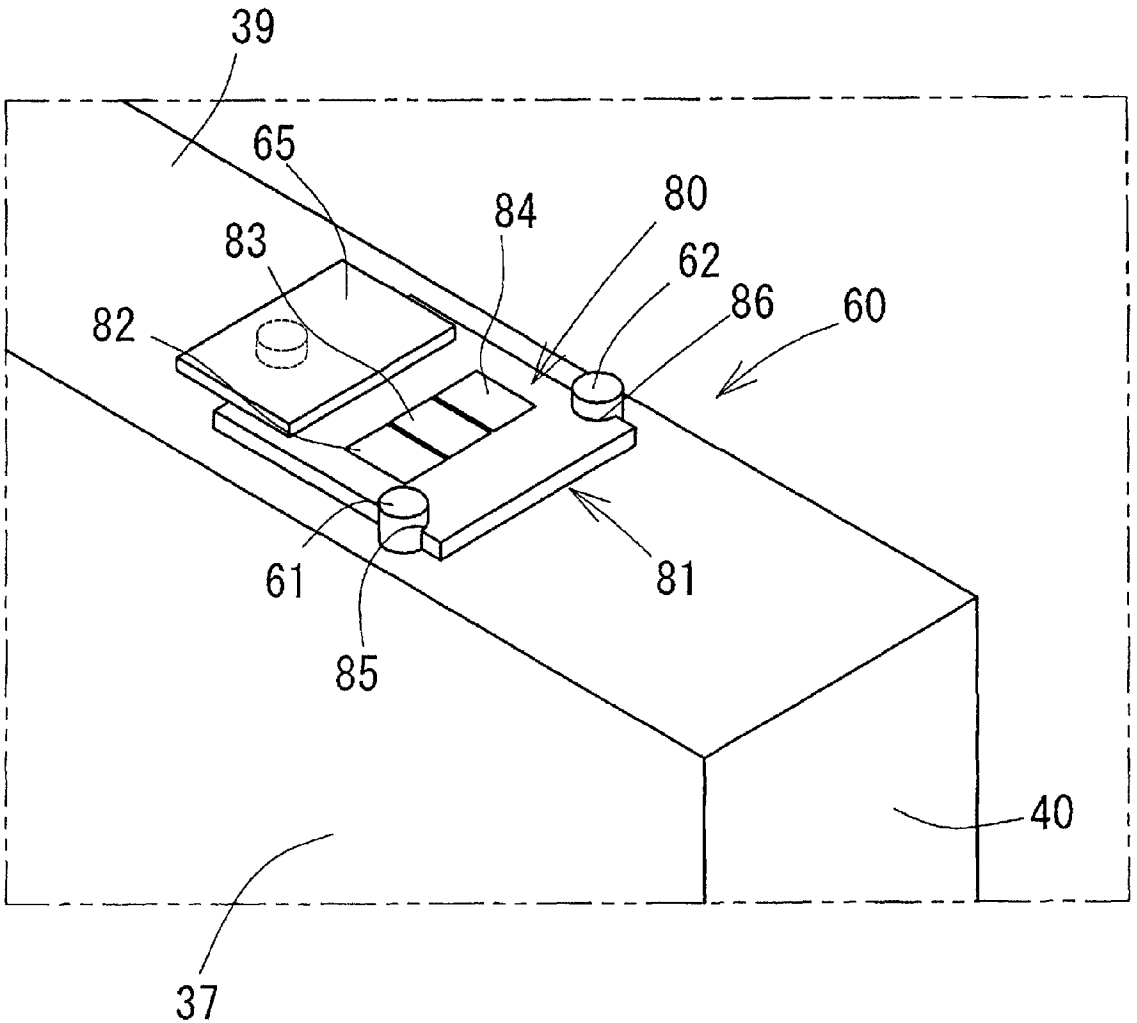
FIG. 7 is a perspective view of an IC substrate affixed to a cartridge according to another embodiment of the invention.

Fixing layer 64 comprising a resin that solidifies when cooled after melting may be applied to circuit board 81 and to the gap between circuit board 81 and rib 63. In another embodiment, as depicted in FIG. 7, a contact plate 65 may contact the upper surface of circuit board 81. Contact plate 65 may be affixed to upper wall 39 by heat application. In this case, circuit board 81 may be affixed by pressing contact plate 65 onto circuit board 81 without applying the hot-melt adhesive onto circuit board 81. Contact plate 65 may cover a rearward portion of circuit board 81 behind electrodes 82, 83, and 84 in length direction 53 and may protrude from circuit board 81 toward rear wall 42. The hot-melt adhesive may be applied to a gap between a protruding portion of contact plate 65 and upper wall 39 to adhere the protruding portion and upper wall 39 to each other.

Circuit board 81 may comprise two notches 85 and 86 formed therein. In another embodiment, circuit board 81 may have an opening and one of notches 85 and 86 or may have two openings instead of notches 85 and 86. The openings may be formed through circuit board 81 in the thickness direction of circuit board 81.

Ink cartridge 30 may comprise an ink remaining amount detecting portion. The ink remaining amount detecting portion may be disposed to protrude from front wall 40 of ink cartridge 30 in a direction away from ink chamber 36. The ink remaining amount detecting portion may be formed of transparent resin. A remaining amount of ink in ink chamber 36 may be inspected through the ink remaining amount detecting portion or an optical sensor may detect the remaining amount of ink through ink remaining amount detecting portion. When the optical sensor is used to detect the remaining amount of ink in ink chamber 36, a distance between a pair of side walls constituting the ink remaining amount detecting portion may be less than a distance between a light-emitting element and a light-receiving element of the optical sensor. A light shield configured to move in accordance with the amount of ink stored in ink chamber 36 may be provided in ink remaining amount detecting portion. Instead of the light shield, ink cartridge 30 may be configured, such that all or portion of light emitted from the light-emitting element may be reflected, diffracted or otherwise attenuated to reduce an amount of light that may reach the light-receiving element in accordance with the amount of ink stored in ink chamber 36.

Ink, as a printing liquid, may be stored in ink cartridge 30 for inkjet-type printer 10. In another embodiment, a cartridge that may store toner as printing liquid for an electrophotographic-type, image forming apparatus.

Main body 31 may have a rectangular, parallelepiped shape. In another embodiment, main body 31 may comprise a plurality of members including a bracket that may cover a part of a rectangular, parallelepiped shaped member for storing ink. In this case, IC substrate 80 may be disposed on the bracket.

IC substrate 80 may be disposed on upper wall 39 of main body 31. In another embodiment, IC substrate 80 may be disposed on any walls disposed between front wall 40 and rear wall 42 of main body 31. For example, IC substrate 80 may be disposed on one of side surfaces 37 and 38 of main body 31. Upper wall 39 of main body 31 may comprise a raised portion, and IC substrate 80 may be disposed on an upper surface, as the support surface, of the raised portion. In this embodiment, IC substrate 80 may be disposed on the support surface that may be the upper surface of the raised portion.

Rib 63 may be disposed in front of or behind electrodes 82, 83, and 84 in length direction 53. Rib 63 may be disposed behind electrodes 82, 83, and 84 to prevent rib 63 from contacting contacts 131, 132, and 133 during the mounting of ink cartridge 30 to cartridge mount 110.

The pair of notches 85 and 86 may be provided as an example of a pair of combination of openings and notches. In another embodiment, the pair of combination of openings and notches may be a pair of openings or a combination of a notch and an opening.

While the invention has been described in connection with various exemplary structures and illustrative embodiments, it will be understood by those skilled in the art that other variations and modifications of the structures, configurations, and embodiments described above may be made without departing from the scope of the invention. For example, this application may comprise many possible combinations of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. A cartridge comprising:

a main body having a chamber formed therein and configured to receive an imaging material;

a circuit board having a first opening and a second opening formed through the circuit board; and an electrode disposed on the circuit board, wherein the main body comprises:

a support surface configured to support the circuit board;

a first protrusion and a second protrusion protruding from the support surface, such that a portion of the first protrusion is disposed in the first opening of the circuit board and a portion of the second protrusion is disposed in the second opening of the circuit board;

a third protrusion protruding from the support surface adjacent to the circuit board; and a fixing element that contacts a portion of the circuit board and a portion of the third protrusion to affix the circuit board to the support surface of the main body.

2. The cartridge according to claim 1 further comprising an imaging material outlet portion protruding from a first surface of the main body and configured to communicate the chamber of the main body with an exterior of the main body.

3. The cartridge according to claim 2, wherein the electrode of the circuit board is disposed between the fixing element and the imaging material outlet portion in a direction in which the imaging material outlet portion protrudes from the first surface of the main body.

4. The cartridge according to claim 2, wherein the first protrusion and the second protrusion are configured to restrict the circuit board from moving on the support surface in a direction in which the imaging material outlet portion protrudes from the first surface of the main body.

5. The cartridge according to claim 2, wherein the first opening is separated from the second opening in a direction parallel to the support surface and to the first surface of the main body, and wherein the first opening and the second opening are notches defined by surfaces of the circuit board perpendicular to the support surface.

6. The cartridge according to claim 5, wherein the notches do not overlap with the electrode in a direction in which the imaging material outlet portion protrudes from the first surface of the main body.

7. The cartridge according to claim 2 further comprising a plurality of electrodes positioned in the circuit board and arranged in a row extending in a direction parallel to the support surface and to the first surface of the main body.

8. The cartridge according to claim 1, wherein the fixing element comprises synthetic resin.

9. The cartridge according to claim 1, wherein the fixing element comprises a contact plate configured to contact the circuit board, and the contact plate is affixed to the support surface via the third protrusion.

10. A method for affixing a circuit board to a support surface of a cartridge, the method comprising:

positioning the circuit board on the support surface, such that a portion of a first protrusion protruding from the support surface is disposed in a first opening of the circuit board and a portion of a second protrusion protruding from the support surface is disposed in a second opening of the circuit board;

positioning a fixing element on a third protrusion protruding from the support surface, such that the fixing element covers a portion of a surface of the circuit board facing away from the support surface; and heating the fixing element to melt a portion of the fixing element, such that the melted portion of the fixing element is affixed to the third protrusion and the portion of the surface of the circuit board.

* * * * *